US008503916B2

(12) United States Patent
Anan et al.

(10) Patent No.: US 8,503,916 B2
(45) Date of Patent: Aug. 6, 2013

(54) DEVELOPING ROLLER, PROCESS CARTRIDGE, AND ELECTROPHOTOGRAPHIC IMAGE FORMING APPARATUS

(75) Inventors: Genya Anan, Numazu (JP); Masahiro Kurachi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/975,348

(22) Filed: Dec. 21, 2010

(65) Prior Publication Data

US 2011/0091240 A1 Apr. 21, 2011

Related U.S. Application Data

(63) Continuation of application No. PCT/JP2010/005601, filed on Sep. 14, 2010.

(30) Foreign Application Priority Data

Sep. 16, 2009 (JP) ..... 2009-214438

(51) Int. Cl.
*G03G 15/08* (2006.01)

(52) U.S. Cl.
USPC ..... 399/286

(58) Field of Classification Search
USPC ..... 399/286, 279; 492/49, 53; 430/120.1
See application file for complete search history.

(56) References Cited

U.S. PATENT DOCUMENTS

| | | | | |
|---|---|---|---|---|
| 4,836,136 | A | 6/1989 | Natsuhara | |
| 7,627,276 | B2 | 12/2009 | Anan et al. | |
| 2008/0317515 | A1 * | 12/2008 | Anan et al. | 399/286 |

FOREIGN PATENT DOCUMENTS

| | | | |
|---|---|---|---|
| JP | 63-217376 | A | 9/1988 |
| JP | 63-217377 | A | 9/1988 |
| JP | 2-32380 | A | 2/1990 |
| JP | 2008-76945 | A | 4/2008 |
| WO | 2008/136291 | A1 | 11/2008 |

OTHER PUBLICATIONS

English translation of International Preliminary Report on Patentability, International Application No. PCT/JP2010/005601, Mailing Date Apr. 19, 2012.

PCT International Search Report and Written Opinion of the International Searching Authority, International Application No. PCT/JP2010/005601, Mailing Date Oct. 26, 2010.

Chinese Office Action dated Jun. 9, 2013 in Chinese Application No. 201080040959.8.

* cited by examiner

*Primary Examiner* — Sophia S Chen

(74) *Attorney, Agent, or Firm* — Fitzpatrick, Cella, Harper & Scinto

(57) ABSTRACT

The present invention can provide a developing roller which can form a stable image in wide ranging environments from a low temperature/low humidity environment to a high temperature/high humidity environment. The developing roller includes a surface layer including a silicon oxide film containing at least a carbon atom chemically bonded to a silicon atom, an oxygen atom chemically bonded to a silicon atom, and a fluorine atom chemically bonded to a silicon atom and/or a carbon atom. The silicon oxide film has an abundance ratio of the fluorine atom to the silicon atom (F/Si), an abundance ratio of the oxygen atom forming a chemical bond to the silicon atom to the silicon atom (O/Si), and an abundance ratio of the carbon atom forming a chemical bond to the silicon atom to the silicon atom (C/Si) have values in particular ranges, respectively.

8 Claims, 4 Drawing Sheets

DEVELOPING ROLLER, PROCESS CARTRIDGE, AND ELECTROPHOTOGRAPHIC IMAGE FORMING APPARATUS

CROSS-REFERENCE TO RELATED APPLICATIONS

This application is a continuation of International Application No. PCT/JP2010/005601, filed Sep. 14, 2010, which claims the benefit of Japanese Patent Application No. 2009-214438, filed Sep. 16, 2009.

BACKGROUND OF THE INVENTION

1. Field of the Invention

The present invention relates to a developing roller, a process cartridge, and an electrophotographic image forming apparatus.

2. Description of the Related Art

In an electrophotographic image forming apparatus, a developing roller to be used for contact development contacts on a toner amount regulating member which regulates an amount of a toner to be transferred to a fixed value. Therefore, when the surface of the developing roller has strong tackiness, the transferred toner occasionally remains adhering to the developing roller. The toner which has adhered to the surface of the developing roller gradually deteriorates due to the repeated contact of the developing roller onto a photosensitive drum, finally fusion-bonding to the surface of the developing roller, and occasionally causes filming. Japanese Patent Application Laid-Open No. S63-217377 and Japanese Patent Application Laid-Open No. S63-217376 propose a developing roller that reduces the filming by forming a surface layer of the developing roller with a fluorine containing amorphous carbon film having release properties with respect to toner. Furthermore, it is necessary for the developing roller in a contact development system in general to have properties of imparting uniform triboelectric charging to the toner and appropriate triboelectric charging according to the developing process, in order to stably provide a clear and uniform image which has high image density and little printing in a part not to be printed, in other words, so-called little fogging. Japanese Patent Application Laid-Open No. H02-32380 proposes a developing roller that has a surface layer including a $SiO_2$ thin film having high triboelectric charging properties, and imparts a high triboelectric charge to the toner for a long period of time.

SUMMARY OF THE INVENTION

An electrophotographic image forming apparatus is required to provide stable image characteristics over a wide range of environments from a low temperature/low humidity environment to a high temperature/high humidity environment. However, as a result of the investigation of the present inventors, the present inventors have found that when the above described developing roller according to Japanese Patent Application Laid-Open No. S63-217377 and Japanese Patent Application Laid-Open No. S63-217376 is used, it is difficult to impart a sufficient amount of negative charge to the toner because the developing roller has a fluorine containing amorphous carbon film with high negatively chargeable properties thereon as its surface layer. Accordingly, the phenomenon of reversal fogging is occasionally observed which occurs particularly in a high temperature/high humidity environment (30° C. and 80% RH), because an amount of triboelectric charging, so-called simply triboelectrification, is excessively low.

On the other hand, the above described developing roller according to Japanese Patent Application Laid-Open No. H02-32380 occasionally imparts an excessive amount of negative charge to the toner, because the $SiO_2$ thin film formed on the surface thereof has high positively chargeable properties. Accordingly, a background fogging originating in the charge-up of a negatively charged toner is occasionally observed, particularly in a low temperature/low humidity environment (15° C. and 10% RH). In addition, because the $SiO_2$ thin film formed on the surface thereof has high affinity with moisture, the $SiO_2$ thin film occasionally cannot impart sufficient triboelectric charging to the toner in the high temperature/high humidity environment, and as a result, fogging (reversal fogging) is occasionally observed. Furthermore, because the $SiO_2$ film formed on the surface of the elastic layer has high hardness, the $SiO_2$ film occasionally cannot follow the deformation of the elastic layer having flexibility, and as a result, a crack has been occasionally formed in the surface thereof. In this case, it is concerned that the low molecular weight component bleeds out from the elastic layer, and the quality of an electrophotographic image is influenced by the adherence of the low molecular weight component onto a photosensitive drum.

Under these circumstances, the present inventors have arrived at acquiring a recognition that in order to further stably obtain high quality electrophotographic images in a contact development system, it is important to develop a developing roller provided with such a surface layer as to have characteristics of: (1) being capable of forming an appropriate image even in various environments (ranging from low temperature/low humidity to high temperature/high humidity); (2) having a surface superior in toner releasing properties; and (3) having sufficient flexibility and hardly causing cracking even when having been subjected to repeating image formation.

Therefore, the present invention is directed to provide a developing roller provided with the surface layer that satisfies the above described requirements (1) to (3).

The present inventors made an extensive investigation in order to solve the above described problems, found that it is necessary to specify a material for forming a surface layer, and finally arrived at the present invention.

According to one aspect of the present invention, there is provided a developing roller for carrying and transporting toner and developing an electrostatic latent image on a photosensitive drum with the toner, comprising a mandrel, an elastic layer and a surface layer in this order, wherein the surface layer comprises a silicon oxide film containing at least a carbon atom chemically bonded to a silicon atom, an oxygen atom chemically bonded to a silicon atom, and a fluorine atom chemically bonded to a silicon atom and/or a carbon atom, and wherein the silicon oxide film has an abundance ratio of the fluorine atom to the silicon atom (F/Si) of 0.10 or more and 0.50 or less, an abundance ratio of the oxygen atom forming a chemical bond to the silicon atom to the silicon atom (O/Si) of 0.50 or more and 1.50 or less, and an abundance ratio of the carbon atom forming a chemical bond to the silicon atom to the silicon atom (C/Si) of 0.30 or more and 1.50 or less.

According to another aspect of the present invention, there is provided a process cartridge comprising a photosensitive drum and a developing roller that is arranged so as to contact on the photosensitive drum, which is structured so as to be detachably mounted on a main body of an electrophotographic image forming apparatus, wherein the developing roller is the above described developing roller.

According to further aspect of the present invention, there is provided an electrophotographic image forming apparatus comprising a photosensitive drum and a developing roller that is arranged so as to contact on the photosensitive drum, wherein the developing roller is the above described developing roller.

The developing roller, the process cartridge and the electrophotographic image forming apparatus according to the present invention can impart appropriate triboelectrification to the toner even in wide ranging environments, and accordingly can provide a stable image.

Further features of the present invention will become apparent from the following description of exemplary embodiments with reference to the attached drawings.

DESCRIPTION OF THE EMBODIMENTS

Figure 1:
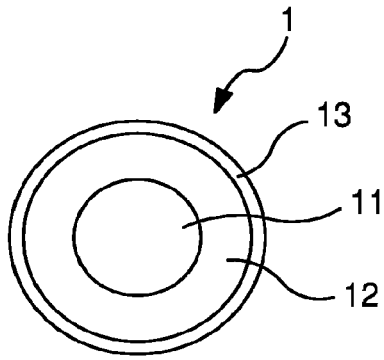
FIG. 1 is a cross-sectional view of one example of a developing roller.

FIG. 1 illustrates a cross section of a developing roller according to the present invention. The developing roller 1 normally has a mandrel 11 which is formed from an electroconductive material such as metal, an elastic layer 12 which is formed on the outer peripheral face thereof, and a surface layer 13 which is formed on the outer peripheral face thereof.

<Mandrel 11>

At least the outer peripheral face of the mandrel 11 is formed from such a material as to be sufficiently electroconductive for applying a predetermined voltage to the elastic layer 12 to be formed on the outer peripheral face. The examples of the specific material of the mandrel 11 can include: a mandrel made from one of a metal and an alloy such as Al, a Cu alloy and SUS; a mandrel made from iron having a surface plated with one of Cr and Ni; and a mandrel made from a synthetic resin having a surface plated with one of Cr and Ni.

<Elastic Layer 12>

An elastic layer 12 is formed by using one of a rubber and a resin as the main component of the raw material. Various rubbers which have been conventionally used for a developing roller can be used as the rubber of the main component of the raw material. Specifically, the rubber includes ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, NBR hydride, polysulfide rubber and urethane rubber.

The resin of the main component of the raw material is mainly a thermoplastic resin, and the examples include for instance: polyethylene resins such as low-density polyethylene (LDPE), high-density polyethylene (HDPE), straight-chain low-density polyethylene (LLDPE) and ethylene-vinyl acetate copolymer resin (EVA); polypropylene resins; polycarbonate resins; polystyrene resins; ABS resins; polyimide; polyester resins such as polyethylene terephthalate and polybutylene terephthalate; fluororesins; and polyamide resins such as polyamide 6, polyamide 66 and MXD6. Furthermore, the rubber or the resin material of the main component can be appropriately blended with components such as conductive agent, non-conductive filler, extender and oxidation inhibitor, and with various additive components used for forming a rubber molded body and a resin molded body, for instance, crosslinking agent, catalyst and dispersion-accelerating agent. These rubbers and resins may be used singly or in a form of two or more of them being mixed.

The conductive agent includes ion conductive substance acting according to ion conducting mechanism, and conductive imparting agent acting according to electron conducting mechanism. Any one of them or both of them can be used.

Specific examples of the conductive imparting agent acting according to the electron conducting mechanism include: powders and fibers of metal such as aluminum, palladium, iron, copper and silver; metal oxides such as titanium oxide, tin oxide and zinc oxide; powders of metal compounds such as copper sulfide and zinc sulfide; powders of suitable particles having substances such as tin oxide, antimony oxide, indium oxide, molybdenum oxide, zinc, aluminum, gold, silver, copper, chromium, cobalt, iron, lead, platinum and rhodium adhered to their surfaces by methods such as electrolysis treatment, spray coating, and mixing and shaking; and carbon black type conductive agents such as acetylene black, Ketjen Black (trade name), PAN type carbon black, pitch type carbon black, and carbon nanotubes.

Specific examples of the ion conductive substance acting according to the ion conducting mechanism include: alkali metal salts such as $LiCF_3SO_3$, $NaClO_4$, $LiClO_4$, $LiAsF_6$, $LiBF_4$, NaSCN, KSCN and NaCl; ammonium salts such as $NH_4Cl$, $NH_4SO_4$ and $NH_4NO_3$; alkaline earth metal salts such as $Ca(ClO_4)_2$ and $Ba(ClO_4)_2$; complexes of the alkaline earth metal salts with a polyalcohol such as 1,4-butanediol, ethylene glycol, polyethylene glycol, propylene glycol and polypropylene glycol, or with a derivative thereof; complexes of the alkaline earth metal salts with a monool such as ethylene glycol monomethyl ether, ethylene glycol monoethyl ether, polyethylene glycol monomethyl ether and polyethylene glycol monoethyl ether; cationic surfactants such as a quaternary ammonium salt; anionic surfactants such as an aliphatic sulfonate, an alkyl sulfuric ester salt and an alkyl phosphate ester salt; and amphoteric surfactants such as betaine. The above described various conductive agents can be used singly or in a form of two or more of them being mixed.

In addition, a method of adding a conductive polymer compound in place of or together with the conductive agent can also be used as a process of imparting electroconductivity to the elastic layer. The conductive polymer compound is a polymer compound which includes a polymer having a conjugate system such as polyacetylene, as a host polymer and a dopant such as $I_2$ doped in the host polymer to become electroconductive. Specific examples of the host polymer will be shown below.

The specific examples of the host polymer include: polyacetylene, poly(p-phenylene), polypyrrole, polythiophene, poly(p-phenylene oxide), poly(p-phenylene sulfide), poly(p-phenylene vinylene), poly(2,6-dimethylphenylene oxide), poly(bisphenol A carbonate), polyvinylcarbazole, polydiacetylene, poly(N-methyl-4-vinylpyridine), polyaniline, polyquinoline, and poly(phenylene ether sulfone).

The dopant includes halogens such as $Cl_2$, $Br_2$, ICl, $ICl_3$, IBr and $IF_3$, in addition to $I_2$; Lewis acids such as $PF_5$, $AsF_5$, $SbF_5$, $FeCl_3$, $AlCl_3$ and $CuCl_2$; alkali metals such as Li, Na, Rb and Cs; alkaline earth metals such as Be, Mg, Ca, Sc and Ba; and aromatic sulfonic acids such as para-toluenesulfonic acid, benzenesulfonic acid, anthraquinonesulfonic acid, naphthalenesulfonic acid, naphthalenedisulfonic acid and naphthalenetrisulfonic acid, or alkali metal salts thereof.

The carbon black type conductive agents are easily available at relatively low costs, can also provide adequate conductivity without depending on the types of the rubber or resin material of the main component, and accordingly can be often used. Conventionally used methods may be appropriately used as a method for dispersing a fine powder of the conductive agent into the rubber or resin materials of the main component, according to types of the rubber and resin materials of the main component.

Specific examples of the filler or the extender include silica, quartz fine powder, diatomaceous earth, zinc oxide, basic magnesium carbonate, active calcium carbonate, magnesium silicate, aluminum silicate, titanium dioxide, talc, mica powder, aluminum sulfate, calcium sulfate, barium sulfate, glass fiber, organic reinforcing agent and organic filler. The surfaces of these fillers may be treated with an organosilicon compound to acquire hydrophobicity thereon. Known oxidation inhibitors such as a hindered phenol-based oxidation inhibitor can be used as an oxidation inhibitor.

For instance, a rubber molded body can be prepared from silicone rubber, by using liquid silicone rubber as a main agent, polyorganohydrogen siloxane as a crosslinking component, and a platinum-based catalyst to crosslink the rubber components with each other.

In addition, the thickness of the elastic layer can be 0.5 mm or more and further can be 1.0 mm or more, in order that the elastic layer contacts on a photosensitive drum, ensures the nip width, and besides, satisfies suitable setting properties. There is no particular upper limit of the thickness for the elastic layer unless the precision of the outer diameter of the developing roller to be prepared is impaired. However, if the thickness of the elastic layer is excessively increased, a contact portion is largely deformed when the elastic layer is left for a long period of time in a state in which the developing roller contacts with a contacting member, and distortion occasionally remains, which is not preferable. Therefore, practically, the thickness of the elastic layer is suitably 6.0 mm or less and can be further 5.0 mm or less. The thickness of the elastic layer can be appropriately determined according to the hardness of the elastic layer, in order to achieve a target nip width.

The elastic layer can be formed by conventionally known forming methods such as extrusion molding methods and injection molding methods. The elastic layer can also be constituted by two or more layers. The tensile elastic modulus of the elastic layer having a surface layer can be 1.0 MPa or more and 100.0 MPa or less, and further can be 1.0 MPa or more and 30.0 MPa or less in particular. When the tensile elastic modulus of the elastic layer having the surface layer is set to be in the above described numerical value range, even if the developing roller is left in a state of contacting with a contacting member such as an electrophotographic photosensitive member, for a long period of time, pressure contact permanent deformation is difficult to occur in the contact portion of the developing roller. In addition, the pressure applied to the toner passing between the contacting member and the developing roller does not become excessively large, and the bleed of a component such as wax in the toner can be effectively suppressed. As a result, a streak image can be reduced which occurs due to a toner fusion-bonding to a toner amount regulating member.

Figure 2:
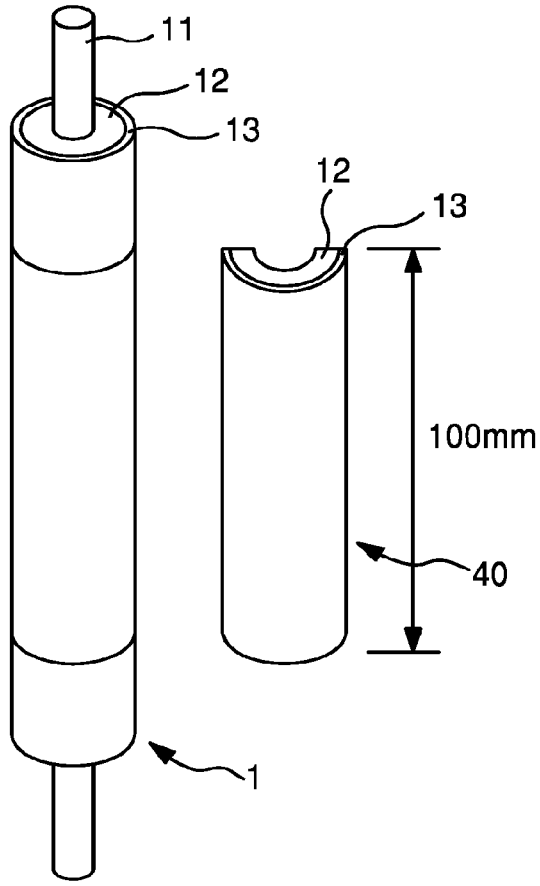
FIG. 2 is an explanatory view illustrating a method of collecting a test piece for the measurement of a tensile elastic modulus.

The tensile elastic modulus is measured according to the method described in JIS-K7113 (1995). In the present invention, as illustrated in FIG. 2, a sample is cut out from the developing roller 1 so as to have a length of 100 mm and correspond to the half of the perimeter of the developing roller, and is used as a test piece 40 for the measurement of the tensile elastic modulus. The universal tensile tester "TENSILON RTC-1250A" (trade name and made by ORIENTEC CO., LTD.) is used for measurement. The measurement environment is set at a temperature of 20° C. and a humidity of 60% RH. Then, the measurement is performed by setting 10 mm of each end of the test piece 40 for the measurement of the tensile elastic modulus in a chuck, setting a length between chucks at 80 mm and setting a measurement speed at 20 mm/min. The cross-section of the test piece 40 for the measurement of the tensile elastic modulus is determined from the obtained tensile elastic modulus and the thickness and peripheral length of the elastic layer of the test piece 40, and the average value of five samples is calculated. Thus calculated value is determined to be the tensile elastic modulus of the elastic layer having the surface layer of the developing roller.

<Surface Layer>

A surface layer 13 includes a silicon oxide film containing a carbon atom chemically bonded to a silicon atom, an oxygen atom chemically bonded to the silicon atom, and a fluorine atom chemically bonded to the silicon atom and/or the carbon atom (hereinafter referred to also as a "SiOxCyFz film" in some case). In other words, the SiOxCyFz film included in the surface layer 13 has chemical bonds of Si—O and Si—C. The SiOxCyFz film further has chemical bonds of Si—F and/or C—F. The abundance ratio of the fluorine atom chemically bonded to the silicon atom and/or the carbon atom to the silicon atom (F/Si) is 0.10 or more and 0.50 or less. In addition, the abundance ratio of the oxygen atom having a chemical bond to the silicon atom to the silicon atom (O/Si) is 0.50 or more and 1.50 or less. Furthermore, the abundance ratio of the carbon atom forming a chemical bond with the silicon atom to the silicon atom (C/Si) is 0.30 or more and 1.50 or less.

When the abundance ratio F/Si is less than 0.10, the surface layer acquires excessively high affinity with moisture, accordingly the triboelectric charging imparting properties to toner decrease, and fogging occasionally Occurs in a high temperature/high humidity environment (30° C. and 80% RH). On the other hand, in a low temperature/low humidity environment (15° C. and 10% RH), the triboelectric charging imparting properties to the toner are excessively high, accordingly the charge-up of the toner occurs, and the background fogging occasionally occurs. This is considered to be because when the above described abundance ratio F/Si becomes smaller than 0.10, the positively chargeable properties of the surface layer become excessively high and accordingly the background fogging occurs.

In addition, when the abundance ratio F/Si is more than 0.50, the negatively chargeable properties of the surface layer become high on the contrary, the surface layer becomes difficult to impart an appropriate amount of electrostatic charge to the toner, and reversal fogging occasionally occurs in the high temperature/high humidity environment.

In addition, if the abundance ratio O/Si is less than 0.50, the hole in the surface layer becomes large. Accordingly, it is difficult to prevent the low molecular weight substance from bleeding out from the elastic layer, which causes a problem of the contamination of the component into the contacting photosensitive drum in some case, when the surface layer is used for the developing roller. On the other hand, if the abundance ratio O/Si is more than 1.50, the SiOxCyFz film itself tends to be hard and cause a crack therein, so a streak tends to be formed in obtained images originating in the cracking, when the surface layer is used for the developing roller.

In addition, if the abundance ratio C/Si is less than 0.30, the adhesiveness between the film of silicon oxide and the surface of the elastic layer decreases, and it occasionally becomes difficult to obtain a uniform and appropriate surface layer. On the other hand, if the abundance ratio C/Si is more than 1.50, the surface of the film tends to become tacky (sticky), and when the surface layer is used for the developing roller, release properties of the surface layer for toner are lowered, and filming tends to occur. The abundance ratio of each element in the surface layer is obtained in the following way.

The abundance ratios of all the elements including light elements were measured with a high-frequency glow discharge optical emission surface spectrometry while using a glow discharge optical emission spectrometry "GD-PROFILER 2-type GD-OES" (trade name and made by HORIBA, Ltd.). As for the measurement conditions, a measurement mode is pulse sputtering, a diameter of an anode (analyzed area) is set at 4 mm by a diameter, an electric discharge power is set at 35 W, and a pressure of Ar gas is set at 600 Pa.

It is desirable that the ratio of the total number of existing elements of a silicon atom (Si), an oxygen atom (O), a carbon atom (C), a fluorine atom (F) and a hydrogen atom (H) which are included in the surface layer with respect to the number of all detected elements is 90% or more. An atom ratio and chemically bonding state in the surface layer are obtained with an X-ray photoelectron spectroscopy in the following way. Peaks originating in the bonding energy of the 2p orbit of Si and the 1s orbit of O, C and F on the surface of the surface layer 13 of the developing roller are measured by using the X-ray photoelectron spectrometer "Quantum 2000" (trade name and made by ULVAC-PHI, Inc.) and using AlKα as an X-ray source.

The abundance ratio of each atom is calculated from respective peaks, and F/Si, O/Si and C/Si are determined from the obtained abundance ratios.

A method for forming a surface layer (SiOxCyFz film) on the elastic layer includes: wet coating methods such as a dip coating method, a spray coating method, a roll coating method and a ring coating method; physical vapor deposition (PVD) methods such as a vacuum deposition method, a sputtering method and an ion plating method; and chemical vapor deposition (CVD) methods such as a plasma CVD method, a thermal CVD method and a laser CVD method.

Among them, the plasma CVD method can be used in consideration of the adhesiveness between the elastic layer and the surface layer (the SiOxCyFz film), a treatment period of time and a treatment temperature, the simpleness of the apparatus and the uniformity of an obtained surface layer.

Figure 3:
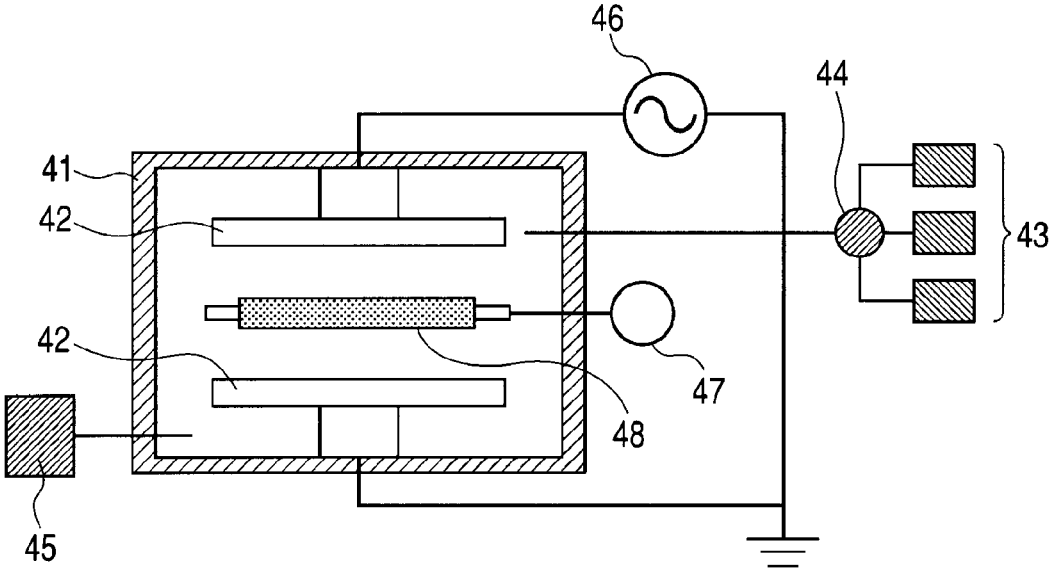
FIG. 3 is a schematic view of an apparatus for producing SiOxCyFz layer by a plasma CVD method.

An example of a method for forming the SiOxCyFz film by a plasma CVD method will be shown below. FIG. 3 is a schematic view of an apparatus for forming an SiOxCyFz film by this plasma CVD method. The apparatus includes a vacuum chamber 41, plate electrodes 42 placed in parallel, a raw material gas cylinder and a raw material liquid tank 43, a raw material supply unit 44, a gas exhausting unit 45 from the chamber, a high-frequency supply power source 46 for supplying a high-frequency power, and a motor 47 for rotating an elastic roller 48. A developing roller having the SiOxCyFz film as the surface layer can be produced by the following procedures (1) to (4), while using the apparatus illustrated in FIG. 3.

The procedures of producing the developing roller include: procedure (1) of placing the elastic roller 48 in which an elastic layer is formed on a mandrel between the plate electrodes 42, and rotating the elastic roller 48 in the circumferential direction by driving the motor 47 so that the SiOxCyFz film to be obtained is uniform; procedure (2) of evacuating the inside of the vacuum chamber 41 by operating a gas exhaust unit 45; procedure (3) of introducing a raw material gas by a raw material supply unit 44, supplying a high-frequency power to the plate electrodes 42 from a high-frequency supply power source 46 to generate plasma, and forming the film; and procedure (4) of stopping the supply of the raw material gas and the high-frequency power after a predetermined period of time has passed, introducing (leaking) air or nitrogen into the vacuum chamber 41 until reaching atmospheric pressure, and then taking out the elastic roller 48.

According to the procedures as described above, the developing roller having the surface layer including the SiOxCyFz film can be produced. For information, many elastic rollers 48 may be simultaneously treated with the plasma CVD method if they could be placed in a uniform plasma atmosphere. Here, usually, a gaseous or gasified silicon compound is introduced into the vacuum chamber 41 as the raw material gas, together with a gaseous or gasified fluorocarbon compound as needed, in the coexistence of or in the absence of a gas such as an inert gas and an oxidizing gas. Furthermore, a gaseous or gasified fluorine containing silicon compound is introduced into the vacuum chamber 41, together with a hydrocarbon compound as needed, in the coexistence of or in the absence of a gas such as an inert gas and an oxidizing gas. Examples of the above described hydrocarbon compound include, for instance, toluene, xylene, methane, ethane, propane and acetylene. Examples of the organosilicon compound include 1,1,3,3-tetramethyldisiloxane, hexamethyldisiloxane, vinyltrimethylsilane, methyltrimethoxysilane, hexamethyldisilane, methylsilane, dimethylsilane, trimethylsilane, tetramethylsilane, diethylsilane, propylsilane, phenylsilane, vinyltriethoxysilane, vinyltrimethoxysilane, tetramethoxysilane, tetraethoxysilane, phenyltrimethoxysilane, methyltriethoxysilane and octamethylcyclotetrasiloxane. Among them, 1,1,3,3-tetramethyldisiloxane, hexamethyldisiloxane and tetramethylsilane can be used which are easily handled.

A silane source is not limited to the organosilicon compound, and silanes such as tetrafluorosilane, aminosilane and silazane can also be used, for instance. When the raw material substance is gaseous, it is used as it is. When the raw material substance is liquid at room temperature, it is heated, vaporized, and carried by an inert gas, or bubbled by an inert gas and carried for use. Furthermore, when the raw material substance is solid at room temperature, it is heated, vaporized, and carried by an inert gas for use. In addition, the vaporization of the raw material substances may be accelerated by being placed in a state of a reduced pressure.

Examples of the fluorocarbon compound include tetrafluoromethane, tetrafluoroethylene, hexafluoropropylene, fluoroalkyl methacrylate, trifluoroethanol, trifluoroacetic acid, fluorobutyric acid, trifluoropropene, trifluoroacetone, hexafluoroacetone, trifluoromethyl benzyl alcohol, trifluoromethyl benzoic acid, trifluoromethyl benzilaldehyde, fluorobenzene, trifluoroacetaldehyde ethyl hemiacetal and trifluoroethyl acrylate.

Specific examples of the fluorine containing silicon compound include fluorotrimethylsilane, difluorodimethylsilane, methyltrifluorosilane, fluorotriethoxysilane, 1,2-difluoro-1,1,2,2-tetramethyl disilane and difluorodimethoxysilane.

For information, when the raw material is an oxygen containing compound, it is possible to form the SiOxCyFz film by deposition even when oxygen does not exist in the vacuum chamber. It is also possible to introduce an oxidizing gas such as oxygen and an oxidative gas ($N_2O$ and $CO_2$, for instance) into the vacuum chamber together with the above described raw material gas. In addition, the inert gas that can be used in the above described process includes a gas such as helium, argon and nitrogen, for instance.

The abundance ratio of a silicon atom, a fluorine atom chemically bonded to the silicon atom and/or a carbon atom, an oxygen atom chemically bonded to the silicon atom, and a carbon atom chemically bonded to the silicon atom in the SiOxCyFz film can be controlled according to conditions such a blending ratio of the raw material gases to be introduced and the high-frequency power to be supplied. Specifically, the abundance ratio of the carbon atom chemically bonded to the silicon atom increases by increasing the mixing ratio of a carbon containing silicon compound gas and/or a carbon containing compound gas. The abundance ratio of the carbon atom chemically bonded to the silicon atom increases due to the increase of the number of the carbon atoms included in the carbon containing silicon compound. The same phenomenon is observed in the fluorine atom and/or the oxygen atom. Furthermore, such a phenomenon is also observed that by increasing the output of the high-frequency power, each atom constituting the raw material gas tends to easily disassociate and the abundance ratio of each atom chemically bonded to the silicon atom decreases.

The thickness of the SiOxCyFz film formed in this manner can be 15 nm or more and 5,000 nm or less, and further can be 300 nm or more and 3,000 nm or less. When the film thickness is controlled to a numerical value in the above described range, the SiOxCyFz film becomes practically sufficient for the wear resulting from a long-term use as well. In addition, even when the SiOx film is produced by the above described CVD method, it can be effectively suppressed that the temperature of the elastic layer is excessively raised and the properties of the elastic layer change.

In the above description, the film thickness of the formed SiOxCyFz film is an average value of values obtained by having measured 9 spots in total of 3 spots equally spaced in the circumferential direction of the developing roller for each of 3 spots equally spaced in the lengthwise direction from an end portion, by using a thin film measurement instrument (trade name: F20-EXR; made by Filmetrics, Inc.).

Figure 4:
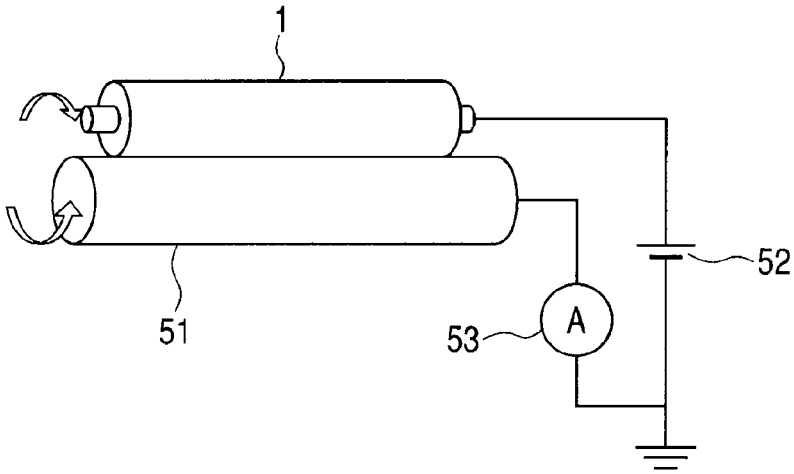
FIG. 4 is an explanatory view illustrating a method for measuring an electric current value of the developing roller.

In the developing roller according to the present invention, the current value measured when the DC voltage of 50 V is applied to the developing roller which is rotating, as is illustrated in FIG. 4, can be 5 μA or more and 5,000 μA or less, and particularly can be 100 μA or more and 500 μA or less. When the current value is controlled to the numerical value in the above described range, a developing bias sufficient for development can be easily obtained when an electrostatic latent image formed on an electrophotographic photosensitive drum is developed with toner. Accordingly, an electrophotographic image having sufficient density can be obtained. In addition, even when pinholes have occurred on the surface of the electrophotographic photosensitive drum, bias leak is difficult to occur, and accordingly, it can be effectively suppressed that an image such as a transverse streak originating in the pinholes occurs in the electrophotographic image.

The outer peripheral face of a developing roller 1 is contacted with a cylindrical electrode 51 which is made from SUS and has a diameter of 40 mm, by applying a load of 500 g to each of exposed portions of the mandrel of the developing roller 1. The cylindrical electrode 51 is rotated in this state, and the developing roller 1 is rotated in the circumferential direction at the speed of 24 rpm by associated rotation. When the rotation becomes stable, voltage is applied to the mandrel from a direct current power source 52, and the voltage of 50 V is applied between the mandrel and the cylindrical electrode 51. The environment at this time shall be 20° C. and 50% RH. Current values of the developing roller 1 by one rotation are measured with an ammeter 53, and the average value of the current values is determined to be the current value. In the present specification, the current value measured in this manner is referred to as "the current value of the developing roller". It is important to control this current value of the developing roller properly and uniformly, in terms of keeping the strength of an electric field to move the toner proper and uniform.

Figure 5:
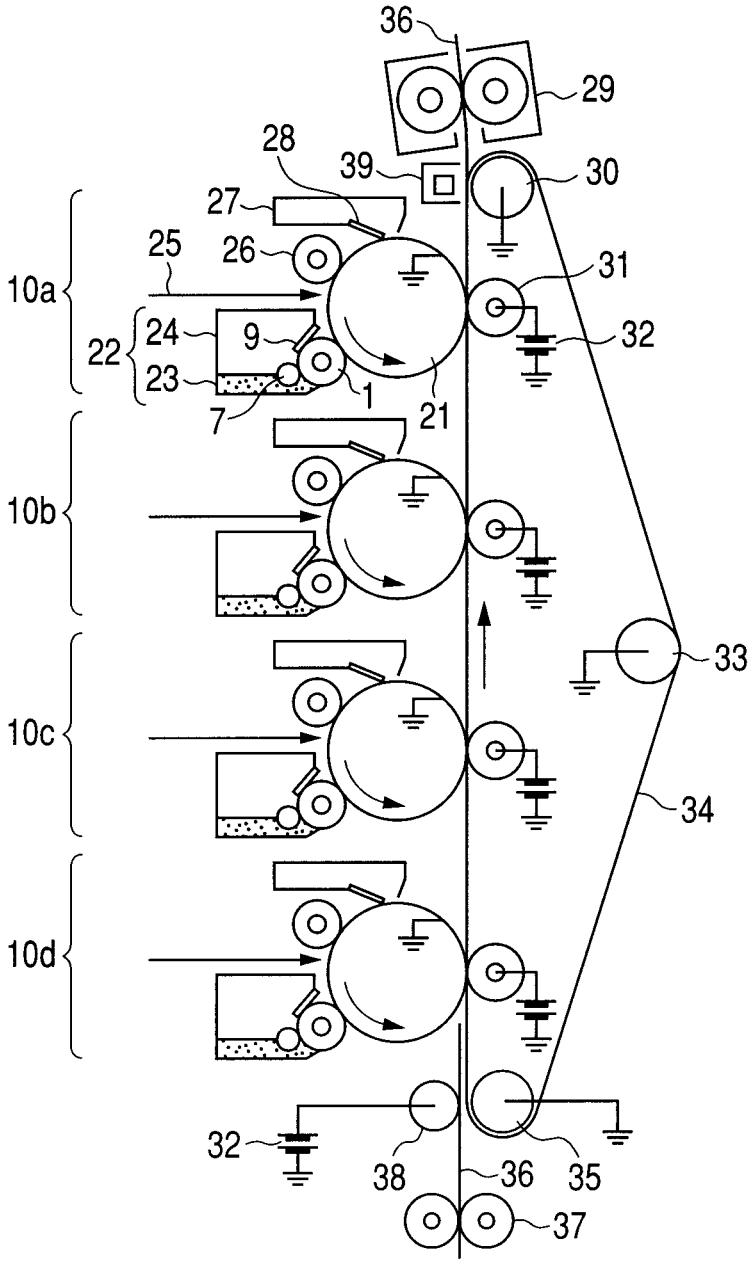
FIG. 5 is a schematic view illustrating one example of a developing apparatus having a developing roller according to the present invention mounted thereon.

FIG. 5 illustrates a cross section of a color electrophotographic image forming apparatus according to the present invention. The color electrophotographic image forming apparatus has image forming part 10 (10*a*, 10*b*, 10*c* and 10*d*), which is provided for each of color toners of yellow Y, magenta M, cyan C and black BK, respectively, in a tandem system. The image forming part 10 is slightly different in their specifications according to respective color toner properties, but basically has the same structure. The image forming part 10 is provided with the photosensitive drum 21 which function as a latent image bearing member and rotate in the arrow direction. A charging member 26 for electrically charging the photosensitive drum 21, a light exposure means for irradiating the electrically charged photosensitive drum 21 with a laser light 25 to form an electrostatic latent image thereon, and a developing apparatus 22 that supplies toner to the photosensitive drum 21 on which the electrostatic latent image has been formed and develops the electrostatic latent image are placed around the photosensitive drum 21. Furthermore, a transfer member is provided which has a transfer roller 31 for transferring a toner image existing on the photosensitive drum 21 to a recording medium 36 such as paper, which is fed by a paper feeding rollers 37 and conveyed by a conveying belt 34, applied voltage from the back surface of the recording medium 36 by a bias power source 32. The conveying belt 34 is suspended by a driving roller 30, a driven roller 35 and a tension roller 33, and is so controlled as to move in synchronization with the image forming part 10 and convey the recording medium 36 so that the toner images formed in the respective image forming part is sequentially superposed and transferred onto the recording medium 36. The recording medium 36 is electrostatically adsorbed to the conveying belt 34 by the operation of an adsorption roller 38 placed right before the conveying belt 34, and results in being conveyed. Furthermore, the color electrophotographic image forming apparatus is provided with a fixing apparatus 29 for fixing the toner images which have been superposed and transferred onto the recording medium 36, by a method such as heating, and also with a conveying apparatus (not illustrated) for ejecting the recording medium 36 having the image formed thereon, out of the color electrophotographic image forming apparatus. The recording medium 36 is peeled from the conveying belt 34 by the operation of a peeling apparatus 39 and results in being sent to the fixing apparatus 29. Further, the image forming part 10 is provided with a cleaning member having a cleaning blade 28 which removes the transfer residual toner that has not been transferred to the recording medium and remains on the photosensitive drum 21 to clean the surface, and also with a waste toner container 27 for storing the toner therein which has been scraped off from the photosensitive drum 21. The cleaned photosensitive drum 21 is made capable of forming an image and stands ready. For information, it is also possible to integrate the photosensitive drum 21, the charging member 26, the developing apparatus 22, the cleaning blade 28 and the waste toner container 27 into a process cartridge. The developing apparatus 22 installed in the above described image forming part 10 is provided with a toner container 24 which accommodates a toner 23, and also with the developing roller 1 which is arranged so as to block the opening of the toner container 24 and so as to oppose to the photosensitive drum 21 in the portion exposed from the toner container 24. The toner container 24 is provided with a roller-shaped toner applying member 7 which contacts on the developing roller 1 and supplies the toner to the developing roller 1, and also with a toner quantity regulating blade 9 which forms the toner supplied to the developing roller 1 into a thin layer and imparts a triboelectric charging to the toner. As the toner applying member 7, for instance, a member in which a foam sponge body or polyurethane foam is formed on a mandrel or a member having a fur brush structure in which fibers such as rayon or polyamide are implanted can be used because of adequately removing the residual toner on the developing roller 1. This toner applying member 7 can be arranged so as to have a suitable contact width on the developing roller 1, and can be rotated in the direction of counter to the developing roller 1 in the contact portion.

Figure 6:
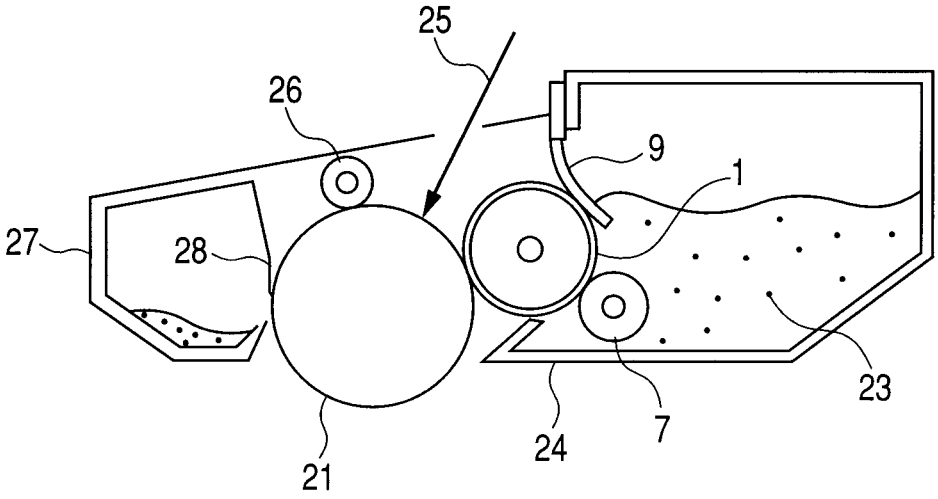
FIG. 6 is a schematic view illustrating a process cartridge having a developing roller according to the present invention mounted therein.

FIG. 6 illustrates a cross section of a process cartridge according to the present invention. The process cartridge includes the photosensitive drum 21, the charging member 26 placed so as to contact on the photosensitive drum 21, the developing apparatus 22, the cleaning blade 28 and the waste toner container 27, and is structured so as to be detachably mounted on the main body of an electrophotographic image forming apparatus. The developing roller 1 is mounted in a state of contacting the photosensitive drum 21 and the toner applying member 7. A toner 23 accommodated in the toner container 24 can be supplied to the developing roller 1 by the toner applying member 7. In this case, the amount of the toner is adjusted by the toner quantity regulating blade 9. Further, an electrostatic latent image is formed on the photosensitive drum 21 electrically charged with the charging member 26 by the laser light 25, and the electrostatic latent image is converted into a visible image by the toner 23 which has been carried on and conveyed by the developing roller 1, to be a toner image. This toner image on the photosensitive drum 21 is transferred onto a recording medium such as paper. Then, the toner 23 remaining on the photosensitive drum 21 is scraped out and is scraped off into the waste toner container 27 by the cleaning blade 28. The process cartridge is thus structured.

EXAMPLES

The present invention will be more specifically described below by way of showing examples. In addition, a purity of used reagents is 99.5% or more unless otherwise specified.

Production Example 1

Production of Elastic Roller 1

A base material of a liquid silicone rubber was prepared by blending 100 parts by mass of dimethylpolysiloxane having a vinyl group at both ends (0.15 mass % of vinyl group content), 7 parts by mass of a quartz powder (trade name: MinUSil; made by Pennsylvania Glass Sand Corporation) as a filler, and 10 parts by mass of carbon black (trade name: DENKA BLACK of a powdered product; made by DENKI KAGAKU KOGYO KABUSHIKI KAISHA).

A solution (A) was prepared by blending 0.5 parts by mass of a complex (0.5 mass %) of chloroplatinic acid and divinyl tetramethyldisiloxane, which functioned as a curing catalyst, with the above described base material. In addition, a solution (B) was prepared by blending 1.5 parts by mass of a dimethylsiloxane-methylhydrogensiloxane copolymer having a Si—H group at both ends (in which the content of H bonded to Si atoms is 0.30%), with the above described base material.

A columnar mandrel which was made from a SUM material, had a diameter of 6 mm and a length of 250 mm and had a surface treated with a primer, was arranged in the center of a cylindrical die. An elastic roller 1 having an elastic layer with a length of 240 mm and a thickness of 3 mm was obtained by injecting a mixture prepared by mixing the above described solution (A) and solution (B) in a mass ratio of 1:1 into this die, curing the mixture by heating the mixture at a temperature of 130° C. for 20 minutes, and further post-curing the mixture at a temperature of 200° C. for 4 hours.

Production Example 2

Production of Elastic Roller 2

A resin mixture was prepared by melting and kneading 100 parts by mass of a polyolefin-based elastomer (trade name: Santoprene 8211-25; made by Advanced Elastomer Systems Japan Ltd.) and 40 parts by mass of MT carbon black (trade name: Thermax Floform N990; made by Cancab Co., Ltd.), and extruding the mixture with the use of a twin screw extruder having a diameter of 30 mm and an L/D of 32.

Subsequently, the above described resin mixture was pelletized. A resin layer was formed on a mandrel (diameter of 6 mm and length of 250 mm) similar to that in Production Example 1 from these pellets by using a crosshead extruder. An elastic roller 2 having an elastic layer with the thickness of 3 mm was obtained, by cutting the ends of this resin layer and further grinding the resin layer portion with a rotary grinding stone.

Production Example 3

Production of Elastic Roller 3

A unvulcanized rubber composition was prepared by kneading 100 parts by mass of ESPRENE 505 (trade name, made by Sumitomo Chemical Co., Ltd.), 50 parts by mass of Diana Process Oil PW380 (trade name: made by Idemitsu Kosan Co., Ltd.), 4 parts by mass of Ketjen Black EC-600JD (trade name, made by Ketjen Black International Company), 60 parts by mass of TOKABLACK #4500 (trade name, made by TOKAI CARBON CO., LTD.), 2 parts by mass of zinc stearate, and 10 parts by mass of zinc oxide, with a 6 liter kneader TD6-15MDX (trade name, made by TOSHIN CO., LTD.). Subsequently, an unvulcanized rubber composition of the elastic body was obtained by mixing 1 part by mass of sulfur which was used as a crosslinking agent and 1 part by mass of mercaptobenzothiazole (MBT) which was used as crosslinking auxiliaries, with the above described unvulcanized rubber composition, by an open roll.

The obtained unvulcanized rubber composition of the elastic body was extruded into a tube shape with a vent type rubber extruder (vent extruder with ϕ50 mm, with L/D of 16 and made by EM ENGINEERING CO., LTD.). After that, the extruded unvulcanized rubber composition was subjected to a primary vulcanization with a pressurized steam at 160° C. for 30 minutes by using a vulcanization can, and a rubber tube was obtained which had an outer diameter of 14 mm, an inner diameter of 5.5 mm and a length of 250 mm.

Subsequently, the above described rubber tube was pushed-in onto a mandrel similar to that in Production Example 1 (diameter of 6 mm and length of 250 mm), and was subjected to the secondary vulcanization in a hot air furnace at 160° C. for 2 hours. An elastic roller 3 having an elastic layer with a thickness of 3 mm was obtained by cutting out both ends of the rubber of the roller after the vulcanization and polishing the rubber portion with a rotary polishing machine.

Production Example 4

Production of Elastic Roller 4

An elastic roller 4 was obtained in a similar way to that in the Production Example 2, except that a polyolefin-based elastomer (trade name: Santoprene 8211-25; made by Advanced Elastomer Systems Japan Ltd.) was changed to LDPE (trade name: NOVATEC LD LJ902; made by Japan Polyethylene Corporation).

Production Example 5

Production of Elastic Roller 5

An elastic roller 5 was obtained in a similar way to that in the Production Example 2, except that a polyolefin-based elastomer (trade name: Santoprene 8211-25; made by Advanced Elastomer Systems Japan Ltd.) was changed to LDPE (trade name: NOVATEC LD LJ802; made by Japan Polyethylene Corporation).

Production Example 6

Production of Elastic Roller 6

An elastic roller 6 was obtained in a similar way to that in the Production Example 2, except that a polyolefin-based elastomer (trade name: Santoprene 8211-25; made by Advanced Elastomer Systems Japan Ltd.) was changed to EVA (trade name: EVAFLEX EV45LX; made by DUPONT-MITSUI POLYCHEMICALS CO., LTD.).

Example 1

The elastic roller 1 was placed in the plasma CVD apparatus illustrated in FIG. 3. After that, the pressure in the vacuum chamber was reduced to 1 Pa with the use of a vacuum pump. Subsequently, a mixture gas of hexamethyldisiloxane vapor and trifluoroethanol vapor was introduced into the vacuum chamber each at a rate of 10 sccm as a raw material gas, and the pressure in the vacuum chamber was set at 7 Pa. After the pressure became constant, an electric power of 70 W with a frequency of 13.56 MHz was supplied to plate electrodes from a high-frequency power source to generate plasma in between the electrodes. The elastic roller 1 placed in the vacuum chamber was rotated at 24 rpm and treated for 300 seconds. After the treatment was finished, the electric power supply was stopped, the raw material gas remaining in the vacuum chamber was exhausted, and air was introduced into the vacuum chamber until the inner pressure reached atmospheric pressure. Then, the developing roller having a surface layer formed thereon was taken out.

The abundance ratio of F/Si and O/Si and the abundance ratio of C/Si on the surface of the obtained developing roller were determined with an X-ray photoelectron spectrometer, and as a result, were 0.30, 1.00 and 0.90, respectively.

In addition, as a result of having measured the thickness of the surface layer of the developing roller by using a thin film measuring apparatus (trade name: F20-EXR; made by Filmetrics, Inc.), the thickness was 500 nm. In the above description, the thicknesses were measured at nine spots in total of three spots equally divided in the circumferential direction of the developing roller for each of three spots equally divided in the lengthwise direction, the average value of the obtained values was determined as the thickness.

Furthermore, the current value of the developing roller was measured by applying a voltage of 50 V to the developing roller, rotating the developing roller at a speed of 24 rpm in an environment with the temperature of 20° C. and the humidity of 50% RH, and was found to be 200 μA.

A test piece was prepared from the developing roller so as to have the length of 100 nm and correspond to the half of the perimeter of the roller according to FIG. 2, and the tensile elastic modulus of the elastic layer having the surface layer (hereinafter referred to as "elastic layer+surface layer") was measured by using the test piece, and the tensile elastic modulus was 1.0 MPa. In the above description, the tensile elastic modulus was measured on five samples by using a universal tensile tester (trade name: TENSILON RTC-1250A; made by ORIENTEC CO., LTD.) in a measurement environment with a temperature of 20° C. and a humidity of 60% RH, and the tensile elastic modulus was determined to be an average value of the measured values.

Example 2

A developing roller was obtained in a similar way to that in Example 1 except that in the formation of a surface layer, the composition of the raw material gas was adjusted to 10 sccm of hexamethyldisiloxane vapor, 200 sccm of oxygen and 10 sccm of trifluoroethanol vapor, and the pressure in the vacuum chamber was set at 40 Pa.

Example 3

The elastic roller 2 was used. A developing roller was obtained in a similar way to that in Example 1 except that in the formation of a surface layer, the composition of the raw material gas was adjusted to 10 sccm of hexamethyldisiloxane vapor and 10 sccm of tetrafluorosilane, and the pressure in the vacuum chamber was set at 6 Pa.

Example 4

A developing roller was obtained in a similar way to that in Example 3 except that in the formation of a surface layer, the composition of the raw material gas was adjusted to 10 sccm of hexamethyldisiloxane vapor, 100 sccm of oxygen and 10 sccm of trifluoroethanol vapor, the pressure in the vacuum chamber was set at 25 Pa, further, the electric power of the high-frequency power source was set at 100 W, and the treatment period of time was set at 150 seconds.

Example 5

A developing roller was obtained in a similar way to that in Example 1 except that in the formation of a surface layer, the composition of the raw material gas was adjusted to 10 sccm of hexamethyldisiloxane vapor, 10 sccm of tetrafluorosilane and 10 sccm of trifluoroethanol vapor, the pressure in the vacuum chamber was set at 8 Pa, and also, the treatment period of time was set at 500 seconds.

Example 6

The elastic roller 4 was used. A developing roller was obtained in a similar way to that in Example 1 except that in the formation of a surface layer, the composition of the raw material gas was adjusted to 10 sccm of hexamethyldisiloxane vapor and 20 sccm of trifluoroethanol vapor, the pressure in the vacuum chamber was set at 8 Pa, further, the electric power of the high-frequency power source was set at 30 W, and the treatment period of time was set at 150 seconds.

Example 7

The elastic roller 3 was used. A developing roller was obtained in a similar way to that in Example 1 except that in the formation of a surface layer, the composition of the raw material gas was adjusted to 10 sccm of hexamethyldisiloxane vapor, 10 sccm of tetrafluorosilane and 20 sccm of trifluoroethanol vapor, and the pressure in the vacuum chamber was set at 10 Pa.

Example 8

The elastic roller 4 was used. A developing roller was obtained in a similar way to that in Example 1 except that in the formation of a surface layer, the composition of the raw material gas was adjusted to 10 sccm of hexamethyldisiloxane vapor, 100 sccm of oxygen and 20 sccm of trifluoroethanol vapor, and the pressure in the vacuum chamber was set at 28 Pa.

Example 9

The elastic roller 3 was used. A developing roller was obtained in a similar way to that in Example 1 except that the electric power of the high-frequency power source was set at 30 W, and the treatment period of time was set at 500 seconds.

Example 10

The elastic roller 3 was used. A developing roller was obtained in a similar way to that in Example 1 except that in the formation of a surface layer, the treatment period of time was set at 600 seconds.

Example 11

A developing roller was obtained in a similar way to that in Example 1 except that in the formation of a surface layer, the composition of the raw material gas was adjusted to 10 sccm of hexamethyldisiloxane vapor, 100 sccm of oxygen and 20 sccm of trifluoroethanol vapor, the pressure in the vacuum chamber was set at 28 Pa, and also, the electric power of the high-frequency power source was set at 100 W.

Example 12

The elastic roller 2 was used. A developing roller was obtained in a similar way to that in Example 1 except that the composition of the raw material gas was adjusted to 20 sccm of fluorotriethylsilane vapor, the pressure in the vacuum chamber was set at 6 Pa, further, the electric power of the high-frequency power source was set at 30 W, and the treatment period of time was set at 150 seconds.

Example 13

The elastic roller 3 was used. A developing roller was obtained in a similar way to that in Example 1 except that in the formation of a surface layer, the composition of the raw material gas was adjusted to 10 sccm of tetrafluorosilane and 10 sccm of trifluoroethanol vapor, the pressure in the vacuum chamber was set at 6 Pa, and the treatment period of time was set at 600 seconds.

Example 14

The elastic roller 3 was used. A developing roller was obtained in a similar way to that in Example 1 except that in the formation of a surface layer, the composition of the raw material gas was adjusted to 30 sccm of hexamethyldisiloxane vapor, 200 sccm of oxygen and 10 sccm of hexafluoropropylene, the pressure in the vacuum chamber was set at 42 Pa, and also, the treatment period of time was set at 600 seconds.

Example 15

A developing roller was obtained in a similar way to that in Example 1 except that in the formation of a surface layer, the composition of the raw material gas was adjusted to 10 sccm of hexamethyldisiloxane vapor, 200 sccm of oxygen and 10 sccm of trifluoroethanol vapor, the pressure in the vacuum chamber was set at 42 Pa, and further the treatment period of time was set at 600 seconds.

Example 16

The elastic roller 3 was used. A developing roller was obtained in a similar way to that in Example 1 except that in the formation of a surface layer, the composition of the raw material gas was adjusted to 10 sccm of hexamethyldisiloxane vapor and 20 sccm of trifluoroethanol vapor, the pressure in the vacuum chamber was set at 8 Pa, further the electric power of the high-frequency power source was set at 30 W, and the treatment period of time was set at 150 seconds.

Example 17

A developing roller was obtained in a similar way to that in Example 1 except that in the formation of a surface layer, the composition of the raw material gas was adjusted to 10 sccm of fluorotriethoxysilane vapor, the pressure in the vacuum chamber was set at 4 Pa, and further the treatment period of time was set at 150 seconds.

Example 18

The elastic roller 3 was used. A developing roller was obtained in a similar way to that in Example 1 except that in the formation of a surface layer, the composition of the raw material gas was adjusted to 30 sccm of hexamethyldisiloxane vapor, 200 sccm of oxygen and 20 sccm of hexafluoropropylene, the pressure in the vacuum chamber was set at 48 Pa, and further the treatment period of time was set at 500 seconds.

Example 19

The elastic roller 6 was used. A developing roller was obtained in a similar way to that in Example 1 except that in the formation of a surface layer, the composition of the raw material gas was adjusted to 10 sccm of fluorotriethoxysilane vapor, the pressure in the vacuum chamber was set at 5 Pa, and further the electric power of the high-frequency power source was set at 150 W.

Example 20

The elastic roller 5 was used. A developing roller was obtained in a similar way to that in Example 1 except that in the formation of a surface layer, the composition of the raw material gas was adjusted to 20 sccm of fluorotriethoxysilane vapor, and the pressure in the vacuum chamber was set at 6 Pa.

Example 21

The elastic roller 4 was used. A developing roller was obtained in a similar way to that in Example 1 except that in the formation of a surface layer, the composition of the raw material gas was adjusted to 10 sccm of tetrafluorosilane and 20 sccm of trifluoroethanol, the pressure in the vacuum chamber was set at 8 Pa, and further the electric power of the high-frequency power source was set at 100 W.

Comparative Example 1

The elastic roller 3 was used. A developing roller was obtained in a similar way to that in Example 1 except that in the formation of a surface layer, the composition of the raw material gas was adjusted to 20 sccm of tetrafluorosilane and 10 sccm of trifluoroethanol, the pressure in the vacuum chamber was set at 8 Pa, and also, the electric power of the high-frequency power source was set at 100 W.

Comparative Example 2

The elastic roller 3 was used. A developing roller was obtained in a similar way to that in Example 1 except that in the formation of a surface layer, the composition of the raw material gas was adjusted to 10 sccm of hexamethyldisiloxane vapor, 100 sccm of oxygen and 5 sccm of trifluoroethanol, and the pressure in the vacuum chamber was set at 25 Pa.

Comparative Example 3

A developing roller was obtained in a similar way to that in Example 1 except that in the formation of a surface layer, the composition of the raw material gas was adjusted to 10 sccm of hexamethyldisiloxane vapor, 200 sccm of oxygen and 20 sccm of trifluoroethanol, and the pressure in the vacuum chamber was set at 42 Pa.

Comparative Example 4

A developing roller was obtained in a similar way to that in Example 1 except that in the formation of a surface layer, the composition of the raw material gas was adjusted to 10 sccm of hexamethyldisiloxane vapor, 10 sccm of tetrafluorosilane and 10 sccm of trifluoroethanol, the pressure in the vacuum chamber was set at 8 Pa, and also, the electric power of the high-frequency power source was set at 30 W.

Comparative Example 5

The elastic roller 4 was used. A developing roller was obtained in a similar way to that in Example 1 except that in the formation of a surface layer, the composition of the raw material gas was adjusted to 10 sccm of hexamethyldisiloxane vapor, 10 sccm of tetrafluorosilane and 100 sccm of oxygen, and the pressure in the vacuum chamber was set at 25 Pa.

Comparative Example 6

A developing roller was obtained in a similar way to that in Example 1 except that in the formation of a surface layer, the composition of the raw material gas was adjusted to 10 sccm of hexamethyldisiloxane vapor and 30 sccm of trifluoroethanol, the pressure in the vacuum chamber was set at 8 Pa, and also, the electric power of the high-frequency power source was set at 30 W.

The prepared developing rollers in each Example and each Comparative Example were analyzed in a similar way to that in Example 1. The results are shown in Table 1.

TABLE 1

| | Abundance ratio F/Si | Abundance ratio O/Si | Abundance ratio C/Si | Thickness of surface layer (nm) | Current value (μA) | Tensile elastic modulus (MPa) |
|---|---|---|---|---|---|---|
| Ex. 1 | 0.30 | 1.00 | 0.90 | 500 | 200 | 1.0 |
| Ex. 2 | 0.10 | 1.50 | 0.30 | 1500 | 100 | 1.0 |
| Ex. 3 | 0.10 | 0.52 | 0.30 | 1000 | 20 | 10.0 |
| Ex. 4 | 0.10 | 1.50 | 1.50 | 2930 | 16 | 10.0 |
| Ex. 5 | 0.50 | 0.52 | 0.31 | 395 | 120 | 1.0 |
| Ex. 6 | 0.49 | 0.51 | 1.47 | 120 | 2300 | 90.0 |
| Ex. 7 | 0.47 | 1.50 | 1.49 | 480 | 4100 | 30.0 |
| Ex. 8 | 0.49 | 1.47 | 0.33 | 2100 | 35 | 90.0 |
| Ex. 9 | 0.11 | 0.51 | 1.50 | 180 | 5000 | 30.0 |
| Ex. 10 | 0.32 | 0.92 | 1.13 | 1000 | 25 | 30.0 |
| Ex. 11 | 0.28 | 1.48 | 0.31 | 2650 | 11 | 1.0 |
| Ex. 12 | 0.18 | 0.77 | 1.48 | 15 | 260 | 10.0 |
| Ex. 13 | 0.49 | 0.55 | 1.48 | 2500 | 1530 | 30.0 |
| Ex. 14 | 0.22 | 0.73 | 1.19 | 5000 | 5 | 30.0 |
| Ex. 15 | 0.12 | 1.44 | 0.75 | 3000 | 2 | 1.0 |
| Ex. 16 | 0.48 | 0.53 | 1.44 | 60 | 5120 | 30.0 |
| Ex. 17 | 0.27 | 0.91 | 1.23 | 12 | 380 | 1.0 |
| Ex. 18 | 0.31 | 1.11 | 1.44 | 5200 | 85 | 30.0 |
| Ex. 19 | 0.42 | 0.66 | 1.32 | 130 | 1300 | 0.8 |
| Ex. 20 | 0.13 | 0.58 | 1.29 | 980 | 580 | 110.0 |
| Ex. 21 | 0.33 | 1.01 | 0.98 | 630 | 550 | 90.0 |

TABLE 1-continued

| | Abundance ratio F/Si | Abundance ratio O/Si | Abundance ratio C/Si | Thickness of surface layer (nm) | Current value (μA) | Tensile elastic modulus (MPa) |
|---|---|---|---|---|---|---|
| Com. Ex. 1 | 0.58 | 1.03 | 0.88 | 820 | 2300 | 30.0 |
| Com. Ex. 2 | 0.08 | 0.89 | 0.91 | 700 | 390 | 30.0 |
| Com. Ex. 3 | 0.21 | 1.60 | 0.63 | 3300 | 5 | 1.0 |
| Com. Ex. 4 | 0.33 | 0.39 | 1.35 | 820 | 293 | 1.0 |
| Com. Ex. 5 | 0.48 | 0.77 | 0.21 | 720 | 500 | 90.0 |
| Com. Ex. 6 | 0.28 | 0.66 | 1.62 | 98 | 800 | 1.0 |

<Evaluation 1>

The following evaluation items (1) to (6) were evaluated on each of the prepared developing rollers in the above described examples and comparative examples. The evaluation results are shown in Table 2. For the evaluation, a laser printer (trade name: HP Color Laser Jet CP3505dn, made by Hewlett-Packard Company) was used. This laser printer is a printer in which A4 paper is ejected in its longitudinal direction, a speed of ejecting the recording medium is 21 ppm, and the resolution of the image is 3,600 dpi. A contact pressure of the developing roller and its intruding quantity against the toner quantity regulating blade were set so that the amount of the toner carried on the developing roller was 0.35 mg/cm$^2$.

In regard to (1) fogging in a high temperature/high humidity environment and (2) fogging in a low temperature/low humidity environment, each of the developing rollers according to each of Examples and Comparative Examples was incorporated as the developing roller in the cartridge of the above described laser printer. This cartridge was loaded in the above described laser printer, and electrophotographic images were output in the environment of the temperature of 30° C. and the humidity of 80% RH, and in the environment of the temperature of 15° C. and the humidity of 10% RH, respectively. Specifically, 10,000 sheets of 1% printed matter were output with the use of a black toner, and subsequently each one sheet of a solid black image, a solid white image and a halftone image was output. The halftone image has a density of 0.7 as measured by using a densitometer (trade name: Macbeth Color Checker RD-1255; made by Macbeth). A reflection density of the solid white image was measured with a photovoltaic reflection densitometer (trade name: TC-6DS/A; made by Tokyo Denshoku Co., Ltd.), and the difference between reflection densities of the solid white image and a not-printed part was defined as fogging (%). The fogging (%) was evaluated according to the following criteria.

A: less than 1.5%.

B: 1.5% or more and less than 3.0%.

C: 3.0% or more.

In regard to (3) the presence or absence of an image defect resulting from the cracking of the surface layer and the evaluation on the degree, the image defects resulting from the cracking in the surface layer were evaluated on the solid black image and the halftone image used for the above described evaluation (1), according to the following criteria of: "absent": no streak originating in the cracking in the surface layer of the developing roller is observed in the images; "slight": streaks originating in the cracking in the surface layer of the developing roller are observed in the images but practically cause no problem; and "present": streaks originating in the cracking in the surface layer of the developing roller are observed in the images.

In regard to (4) filming, after the images subjected to the evaluation of the above described (1) were output, the surface of the developing roller was observed with a microscope (trade name: Digital Microscope VH-8000; made by KEYENCE CORPORATION). Then, the presence or absence of the filming, and the presence or absence of image defects resulting from the filming in the images subjected to the evaluation of the above described (1) were evaluated according to the following criteria.

A: no filming on the developing roller.

B: no observable image defect originating in the filming in the images for evaluation, though slight filming of the toner occurs on the developing roller.

C: causing the filming of the toner on the developing roller, and observable image defects originating in the filming in images for evaluation.

In regard to (5) bleed, an effect of the surface layer according to the present invention exerting on the reduction of the bleed of a low molecular weight substance from the elastic layer of the developing roller was tested in the following way. Specifically, a brand-new developing roller according to each example and comparative example was incorporated in a process cartridge, and was left in a state of being contacted with the toner quantity regulating blade and the photosensitive drum, in an environment of 40° C. and 95% RH for 30 days. After that, the process cartridge which had been left was incorporated in a laser printer, and a solid black image and a halftone image were output. The output images were visually observed, and the presence or absence and an extent of the occurrence of defects in the electrophotographic images caused by the adherence of a substance having bled from the elastic layer to the photosensitive drum were evaluated according to the following criteria; none: no image defect due to adherence of bleeding materials; slight: practically no problem though slight image defects due to adherence of bleeding materials can be observed; and present: image defects due to the adherence of bleeding materials are observed.

In regard to (6) the durability of the surface layer, after the images subjected to the evaluation of the above described (1) were output, the surface of the developing roller was observed with a microscope (trade name: Digital Microscope VH-8000; made by KEYENCE CORPORATION). It was confirmed whether the peeling of the surface layer was observed or not, and the extent was evaluated according to the following criteria; none: no peeling of the surface layer is observed; slight: the peeling of the surface layer is observed, but no influence thereof is observed in the images for evaluation; and present: peeling of the surface layer is observed, and influence thereof is observed in the images for evaluation.

TABLE 2

| | (1) Fogging in high temperature/high humidity environment | (2) Fogging in low temperature/low humidity environment | (3) Streak originating in cracking in surface layer | (4) Filming | (5) Bleed | (6) Durability |
|---|---|---|---|---|---|---|
| Ex. 1 | 0.48 | 0.32 | None | A | None | None |
| Ex. 2 | 1.64 | 2.02 | Slight | A | None | Slight |
| Ex. 3 | 1.78 | 2.14 | None | A | Slight | None |
| Ex. 4 | 1.80 | 1.86 | Slight | B | None | None |
| Ex. 5 | 1.70 | 1.21 | None | A | Slight | Slight |
| Ex. 6 | 2.04 | 0.88 | None | B | Slight | None |
| Ex. 7 | 1.82 | 1.03 | Slight | B | None | None |
| Ex. 8 | 2.12 | 1.37 | Slight | A | None | Slight |
| Ex. 9 | 2.56 | 2.17 | None | B | Slight | None |
| Ex. 10 | 1.18 | 0.88 | None | A | None | Slight |
| Ex. 11 | 0.52 | 0.46 | Slight | A | None | None |
| Ex. 12 | 0.67 | 0.51 | None | B | None | None |
| Ex. 13 | 1.93 | 1.22 | None | B | None | None |
| Ex. 14 | 1.05 | 0.73 | None | A | None | None |
| Ex. 15 | 1.95 | 1.97 | Slight | A | None | None |
| Ex. 16 | 2.63 | 1.16 | None | B | Slight | None |
| Ex. 17 | 1.19 | 1.06 | None | A | None | None |
| Ex. 18 | 0.89 | 0.35 | None | B | None | None |
| Ex. 19 | 2.22 | 0.86 | None | A | None | None |
| Ex. 20 | 1.71 | 2.65 | None | A | None | None |
| Ex. 21 | 0.98 | 0.53 | None | A | None | None |
| Com. Ex. 1 | 3.59 | 1.12 | None | A | None | None |
| Com. Ex. 2 | 5.65 | 4.87 | None | A | None | None |
| Com. Ex. 3 | 1.16 | 1.18 | Present | A | None | None |
| Com. Ex. 4 | 0.98 | 1.02 | None | C | Present | None |
| Com. Ex. 5 | * | * | * | * | * | * |
| Com. Ex. 6 | 0.58 | 1.47 | None | C | None | None |

The mark * in Table 2 means that all items in Comparative Example 5 were not evaluated because the surface layer was peeled on the way of the image output for the evaluation (1).

As is shown in Table 2, it was found from the result of the evaluation items (1) and (2) that the developing roller according to the present invention had a superior image performance in a high-temperature and high-humidity environment and a low-temperature and low-humidity environment. It was also found from the result of the evaluation item (3) that the developing roller according to the present invention had sufficient flexibility. It was also grasped from the result of the evaluation item (4) that the developing roller had a surface superior in toner releasing properties. Furthermore, it was grasped from the result of the evaluation item (5) that the developing roller according to the present invention could effectively reduce the bleed of the low molecular weight component from the elastic layer. Still furthermore, it was grasped from the result of the evaluation item (6) that the developing roller according to the present invention had superior adhesiveness between the surface layer and the elastic layer.

<Evaluation 2>

Next, the following evaluation items (7) to (11) were further evaluated on each of the developing rollers according to the Examples 1 to 21.

In regard to (7) density unevenness, the density unevenness was visually observed on the solid black image and the halftone image which were output in the above described evaluation item (1), and was evaluated according to the following criteria. For information, the density unevenness is most easily observable in the halftone image and is relatively easily observable in the solid black image.

A: showing good image without causing visually observable density unevenness in any image.

B: causing observable density unevenness in the halftone image, but causing no observable density unevenness in the solid black image.

C: causing observable density unevenness in any image.

In regard to (8) blade fusion-bonding streak, an occurring state of the streaks originating in the fusion-bonding of the toner, which occurred on the toner quantity regulating blade, on the solid black image and the halftone image that were output in the above described evaluation item (1), was visually observed and evaluated according to the following criteria. For information, the streak is most easily observable in the solid black image and is relatively easily observable in the halftone image.

A: showing good image without causing visually observable streaks in any image.

B: causing observable density unevenness in the solid black image, but causing no observable density unevenness in the halftone image.

C: causing observable density unevenness in any image.

In regard to (9) setting properties, the setting properties of the developing roller, which are associated with the contact with the toner quantity regulating blade, were tested in the following way. Specifically, a brand-new developing roller according to each example was incorporated in a process cartridge, and was left in a state of being contacted with the toner quantity regulating blade, in an environment of 40° C. and 95% RH for 30 days. After that, the process cartridge which had been left was incorporated in a laser printer, and a solid black image and a halftone image were output. The images were visually observed, and the presence or absence and the extent of the occurrence of transverse streaks due to contact marks with the toner quantity regulating blade were evaluated according to the following criteria.

None: causing no observable transverse streak based on contact marks.

Slight: practically causing no problem though a transverse streak due to contact mark is slightly observed.

Present: causing an observable transverse streak due to contact mark.

In regard to (10) a leak image, the presence or absence and the extent of the occurrence of transverse streaks occurring in every rotation cycle of the photosensitive drum were visually observed on the solid black image and the halftone image output in the above described evaluation item (1), and were evaluated according to the following criteria.

Absent: no transverse streak is observed.

Slight: slight transverse streaks are observed but practically cause no problem.

Present: transverse streaks are observed.

In regard to (11) image density, the image densities of the solid black images that were output in the environment of the temperature of 30° C. and the humidity of 80% RH and in the environment of the temperature of 15° C. and the humidity of 10% RH, both in the above evaluation item (1), were measured by using a densitometer (trade name: Macbeth Color Checker RD-1255; made by Macbeth), and were evaluated according to the following criteria.

A: 1.3 or more and less than 1.6 in any image.

B: 1.3 or more and less than 1.6 in one image, but less than 1.3 or 1.6 or more in the other image.

C: less than 1.3 or 1.6 or more in any image.

The results of the above described evaluation items (7) to (11) are shown in Table 3.

TABLE 3

| | (7) Density unevenness | (8) Blade fusion-bonding streak | (9) Setting properties | (10) Leak image | (11) Image density |
|---|---|---|---|---|---|
| Ex. 1 | A | A | None | None | A |
| Ex. 2 | A | A | None | None | A |
| Ex. 3 | A | A | None | None | A |
| Ex. 4 | A | A | None | None | A |
| Ex. 5 | A | A | None | None | A |
| Ex. 6 | A | B | None | None | A |
| Ex. 7 | A | A | None | Slight | A |
| Ex. 8 | A | B | None | None | A |
| Ex. 9 | A | A | None | Slight | A |
| Ex. 10 | A | A | None | None | A |
| Ex. 11 | A | A | None | None | B |
| Ex. 12 | A | A | None | None | A |
| Ex. 13 | A | A | None | None | A |
| Ex. 14 | B | A | None | None | B |
| Ex. 15 | A | A | None | None | C |
| Ex. 16 | A | A | None | Present | A |
| Ex. 17 | A | A | None | None | A |
| Ex. 18 | C | A | None | None | A |
| Ex. 19 | A | A | Present | None | A |
| Ex. 20 | A | C | None | None | A |
| Ex. 21 | A | B | None | None | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This patent application claims the benefit of Japanese Patent Application No. 2009-214438, filed on Sep. 16, 2009, which is hereby incorporated by reference herein in its entirety.

What is claimed is:

1. A developing roller for carrying and transporting toner and developing an electrostatic latent image on a photosensitive drum with the toner, comprising a mandrel, an elastic layer and a surface layer in this order, wherein the surface layer comprises a silicon oxide film containing at least a carbon atom chemically bonded to a silicon atom, an oxygen atom chemically bonded to a silicon atom, and a fluorine atom chemically bonded to a silicon atom and/or a carbon atom, and wherein the silicon oxide film has an abundance ratio of the fluorine atom to the silicon atom (F/Si) of 0.10 or more and 0.50 or less, an abundance ratio of the oxygen atom forming a chemical bond to the silicon atom to the silicon atom (O/Si) of 0.50 or more and 1.50 or less, and an abundance ratio of the carbon atom forming a chemical bond to the silicon atom to the silicon atom (C/Si) of 0.30 or more and 1.50 or less.

2. The developing roller according to claim 1, wherein a thickness of the surface layer is 15 nm or more and 5,000 nm or less.

3. The developing roller according to claim 2, wherein the thickness of the surface layer is 300 nm or more and 3,000 nm or less.

4. The developing roller according to claim 1, wherein a tensile elastic modulus of the elastic layer including the surface layer is 1.0 MPa or more and 100.0 MPa or less.

5. The developing roller according to claim 1, wherein an electric current value measured when a voltage of 50 V is applied to the developing roller which is being rotated is 5 μA or more and 5,000 μA or less.

6. A process cartridge comprising a photosensitive drum and a developing roller that is arranged so as to contact on the photosensitive drum, which is structured so as to be detachably mounted on a main body of an electrophotographic image forming apparatus, wherein the developing roller is the developing roller according to claim 1.

7. An electrophotographic image forming apparatus comprising a photosensitive drum and a developing roller that is arranged so as to contact on the photosensitive drum, wherein the developing roller is the developing roller according to claim 1.

8. The developing roller according to claim 1, wherein the toner is a negatively chargeable toner.

* * * * *